US010858981B2

(12) United States Patent
Jung

(10) Patent No.: US 10,858,981 B2
(45) Date of Patent: Dec. 8, 2020

(54) WATER JACKET OF ENGINE AND ENGINE COOLING SYSTEM HAVING THE SAME

(71) Applicants: HYUNDAI MOTOR COMPANY, Seoul (KR); KIA MOTORS CORPORATION, Seoul (KR)

(72) Inventor: Il Jung, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/454,615

(22) Filed: Jun. 27, 2019

(65) Prior Publication Data

US 2020/0165956 A1 May 28, 2020

(30) Foreign Application Priority Data

Nov. 22, 2018 (KR) ..... 10-2018-0145348

(51) Int. Cl.

| | |
|---|---|
| ***F01P 7/14*** | (2006.01) |
| ***F01P 3/02*** | (2006.01) |
| ***F01P 5/10*** | (2006.01) |
| ***F02F 1/36*** | (2006.01) |
| ***F02F 1/16*** | (2006.01) |

(52) U.S. Cl.

CPC ..... *F01P 3/02* (2013.01); *F01P 5/10* (2013.01); *F01P 7/14* (2013.01); *F02F 1/16* (2013.01); *F02F 1/36* (2013.01); *F01P 2003/021* (2013.01); *F01P 2003/024* (2013.01); *F01P 2007/146* (2013.01); *F01P 2025/32* (2013.01); *F01P 2025/44* (2013.01); *F01P 2025/64* (2013.01)

(58) Field of Classification Search

CPC ..... F01P 3/02; F01P 2003/024; F02F 1/40
USPC ..... 123/41.08
See application file for complete search history.

(56) References Cited

U.S. PATENT DOCUMENTS

| | | | | |
|---|---|---|---|---|
| 8,151,743 | B2 * | 4/2012 | Reustle | B22D 19/0009 123/41.82 R |
| 9,581,072 | B2 * | 2/2017 | Hutchins | F01P 3/02 |
| 9,745,888 | B2 * | 8/2017 | Lee | F01P 7/165 |
| 10,513,969 | B2 * | 12/2019 | Jang | F01P 7/14 |
| 10,563,566 | B2 * | 2/2020 | Brinkmann | F01P 3/02 |
| 2013/0160723 | A1 * | 6/2013 | Miyagawa | F01P 7/16 123/41.1 |
| 2013/0221116 | A1 * | 8/2013 | Tsuchiya | G05D 23/134 236/34.5 |
| 2016/0108858 | A1 * | 4/2016 | Miyahara | F02M 25/0717 123/568.21 |
| 2018/0230934 | A1 * | 8/2018 | Hopf | F01P 11/04 |
| 2019/0128173 | A1 * | 5/2019 | Lee | F01P 7/165 |

(Continued)

*Primary Examiner* — Long T Tran
*Assistant Examiner* — James J Kim
(74) *Attorney, Agent, or Firm* — Brinks Gilson & Lione

(57) ABSTRACT

A water jacket of an engine may include: a block-side water jacket formed in a cylinder block of the engine and surrounding a cylinder of the cylinder block; and a head-side water jacket formed in a cylinder head of the engine and surrounding a combustion chamber and an exhaust port of the cylinder head. In particular, the head-side water jacket includes: a first coolant passage surrounding the combustion chamber of the cylinder head, and a second coolant passage surrounding the exhaust port of the cylinder head, and the second coolant passage is fluidly separated from the first coolant passage.

10 Claims, 4 Drawing Sheets

(56) References Cited

U.S. PATENT DOCUMENTS

2019/0145303 A1* 5/2019 Lee ..... F01P 7/161
123/41.08
2019/0186408 A1* 6/2019 Lee ..... F02M 26/13

* cited by examiner

WATER JACKET OF ENGINE AND ENGINE COOLING SYSTEM HAVING THE SAME

CROSS-REFERENCE TO RELATED APPLICATION

This application claims priority to and the benefit of Korean Patent Application No. 10-2018-0145348, filed on Nov. 22, 2018, the entire contents of which are incorporated herein by reference.

FIELD

The present disclosure relates to a water jacket of an engine and an engine cooling system having the same to improve engine cooling performance and fuel efficiency.

BACKGROUND

The statements in this section merely provide background information related to the present disclosure and may not constitute prior art.

As the temperature of an engine increases during the operation of the engine, an engine cooling system prevents the engine from overheating. The engine cooling system includes a coolant control valve that controls the flow rate and/or flow direction of a coolant in order to improve fuel economy or power output, reduce emissions, and the like.

The coolant control valve may allow the coolant to circulate through a circulation passage between a water jacket and a radiator to regulate the temperature of the coolant, and the coolant control valve may block the flow of the coolant to the radiator in cold starting condition of the engine to warm up the engine. In addition, the coolant control valve may allow the coolant to flow into an oil warmer, an EGR, a heater, and the like, thereby utilizing the coolant as a liquid heat transfer medium in various warm-up operations. Thus, the coolant control valve is also referred to as a thermal management module (TMM) or an integrated thermal management module (ITM).

The water jacket is a coolant passage provided in the engine. The coolant circulates in the water jacket to cool the engine.

The water jacket is divided into a block-side water jacket provided in a cylinder block of the engine and a head-side water jacket provided in a cylinder head of the engine, and the block-side water jacket and the head-side water jacket communicate with each other. The head-side water jacket has a first coolant passage surrounding a combustion chamber and a second coolant passage surrounding an exhaust port, and thus the coolant passing through the head-side water jacket cools the combustion chamber and the exhaust port.

Meanwhile, when the flow rate of the coolant passing around the exhaust port (that is, the flow rate of the coolant passing through the second coolant passage) is large, heat transfer to the coolant increases, and accordingly the overall cooling performance of the vehicle may deteriorate. Thus, it is necessary to increase the capacity of the radiator and the capacity of a cooling fan. On the other hand, when the flow rate of the coolant passing around the exhaust port is small, the cylinder head may be damaged due to heat from emissions.

We have discovered that the conventional head-side water jacket cannot adjust only the flow rate of the coolant passing around the exhaust port independently since the first coolant passage surrounding or covering the combustion chamber and the second coolant passage surrounding or covering the exhaust port are connected directly to each other. This leads to deterioration of cooling performance and damage of the cylinder head.

The above information described in this background section is provided to assist in understanding the background of the inventive concept, and may include any technical concept which is not considered as the prior art that is already known to those skilled in the art.

SUMMARY

An aspect of the present disclosure provides a water jacket of an engine and an engine cooling system having the same, capable of varying a flow rate of a coolant passing around an exhaust port (that is, a flow rate of an exhaust-side coolant passing through a coolant passage surrounding the exhaust port) according to operating conditions of a vehicle, thereby improving engine cooling performance, preventing heat damage to a cylinder head and an exhaust system, and improving fuel efficiency.

According to an aspect of the present disclosure, a water jacket of an engine may include: a block-side water jacket formed in a cylinder block of the engine and surrounding or covering each cylinder of the cylinder block; and a head-side water jacket formed in a cylinder head of the engine and surrounding or covering a combustion chamber and an exhaust port of the cylinder head, wherein the head-side water jacket may include a first coolant passage surrounding or covering the combustion chamber of the cylinder head, and a second coolant passage surrounding or covering the exhaust port of the cylinder head, and the second coolant passage may be fluidly separated from the first coolant passage.

The first coolant passage may be directly fluidly connected to the block-side water jacket.

According to another aspect of the present disclosure, an engine cooling system may include: an engine including a cylinder block having a block-side water jacket and a cylinder head having a head-side water jacket, the head-side water jacket having a first coolant passage surrounding or covering a combustion chamber of the cylinder head, and a second coolant passage surrounding or covering an exhaust port of the cylinder head; a first coolant loop communicating with the block-side water jacket and the first coolant passage of the head-side water jacket; a second coolant loop communicating with the second coolant passage of the head-side water jacket; and a coolant control valve controlling a flow direction and a flow rate of a coolant circulating through the first coolant loop and the second coolant loop.

The first coolant loop may include a coolant pump to circulate the coolant, and a radiator cooling the coolant.

The second coolant loop may include a heater communicating with an outlet of the second coolant passage.

The coolant control valve may include a first inlet fluidly communicating with an outlet of the first coolant passage, a second inlet fluidly communicating with the outlet of the second coolant passage, a first outlet fluidly communicating with an inlet of the radiator, and a second outlet fluidly communicating with an inlet of the second coolant passage.

The engine cooling system may further include: a coolant temperature sensor measuring a temperature of the coolant; an exhaust gas temperature sensor measuring a temperature of an exhaust gas; an RPM (revolutions per minute) sensor to measure an RPM of the engine; and a controller to control the coolant control valve.

The controller may control the coolant control valve to vary the flow rate of the coolant passing through the first coolant passage and the flow rate of the coolant passing through the second coolant passage independently according to operating conditions of the engine.

The controller may reduce an opening rate of a second outlet of the coolant control valve to a predetermined reference opening rate or less when the RPM of the engine measured by the RPM sensor is lower than or equal to a reference RPM.

The controller may reduce the opening rate of the second outlet of the coolant control valve to the predetermined reference opening rate or less when the RPM of the engine measured by the RPM sensor is lower than or equal to the reference RPM, and the temperature of the coolant measured by the coolant temperature sensor is higher than or equal to a reference coolant temperature.

The controller may increase the opening rate of a second outlet of the coolant control valve above the predetermined reference opening rate when the RPM of the engine measured by the RPM sensor exceeds the reference RPM.

The controller may increase the opening rate of the second outlet of the coolant control valve above the predetermined reference opening rate when the RPM of the engine measured by the RPM sensor exceeds the reference RPM, and the temperature of the exhaust gas measured by the exhaust gas temperature sensor is higher than or equal to a reference exhaust gas temperature.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
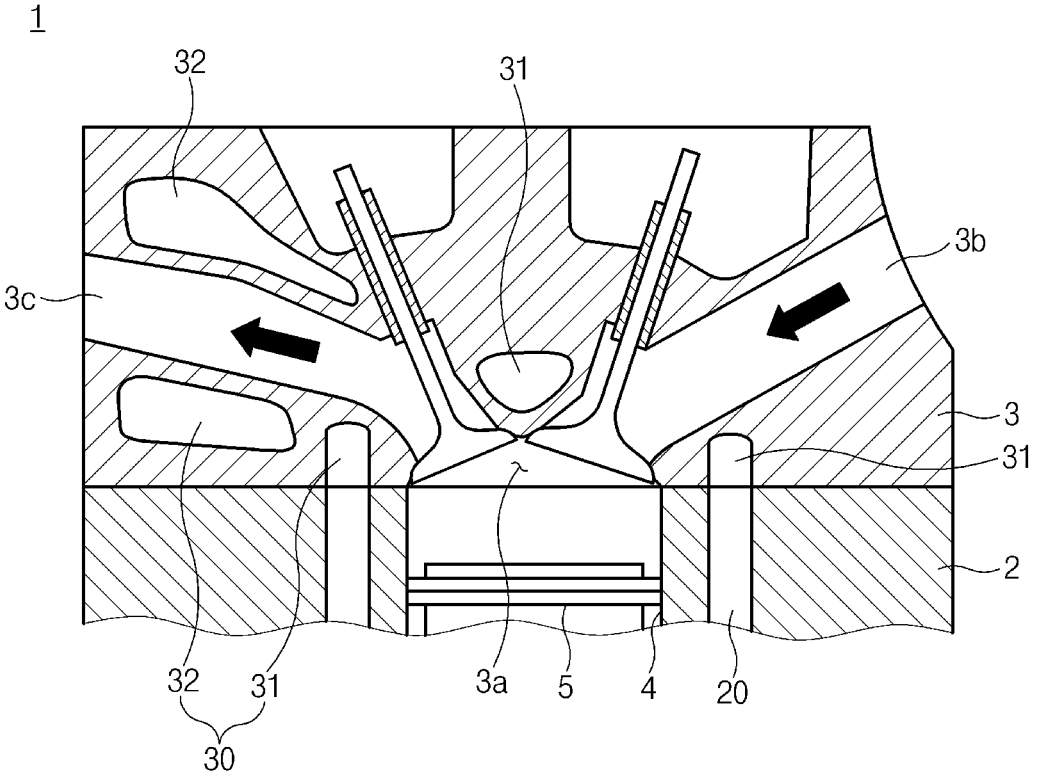
FIG. 1 illustrates a cross-sectional view of an engine according to an exemplary form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

In addition, a detailed description of well-known techniques associated with the present disclosure will be ruled out in order not to unnecessarily obscure the gist of the present disclosure.

Terms such as first, second, A, B, (a), and (b) may be used to describe the elements in exemplary forms of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

Referring to FIG. 1, an engine 1 may include: a cylinder block 2 having a plurality of cylinders 4, and a cylinder head 3 connected to the cylinder block 2.

The cylinder block 2 may have the plurality of cylinders 4, and one cylinder 4 is illustrated in FIG. 1 for convenience of explanation. A piston 5 may be provided to reciprocate in the cylinder 4.

The cylinder block 2 may include a block-side water jacket 20 surrounding or covering the periphery of the cylinder 4, and a coolant may pass through the block-side water jacket 20.

The cylinder head 3 may have a combustion chamber 3*a*, an intake port 3*b*, and an exhaust port 3*c*. The cylinder head 3 may include a head-side water jacket 30 surrounding or covering the combustion chamber 3*a* and the exhaust port 3*c*.

According to an exemplary form of the present disclosure, the head-side water jacket 30 may include a first coolant passage 31 surrounding or covering the periphery of the combustion chamber 3*a*, and a second coolant passage 32 surrounding or covering the periphery of the exhaust port 3*c*.

The first coolant passage 31 may be directly fluidly connected to the block-side water jacket 20, and the first coolant passage 31 may receive the coolant from the block-side water jacket 20. As the coolant sequentially passes through the block-side water jacket 20 and the first coolant passage 31 of the head-side water jacket 30, the cylinder 4 of the cylinder block 2 and the combustion chamber 3*a* of the cylinder head 3 may be cooled.

The second coolant passage 32 may be fluidly separated from the first coolant passage 31 so that the second coolant passage 32 may not be directly fluidly connected to the first coolant passage 31. By separating the second coolant passage 32 from the first coolant passage 31, the flow rate of the coolant passing through the second coolant passage 32 may be varied independently of the flow rate of the coolant (combustion chamber-side coolant) passing through the block-side water jacket 20 and the first coolant passage 31. As the coolant passes through the second coolant passage 32 of the head-side water jacket 30, the exhaust port 3*c* of the cylinder head 3 may be cooled independently of the combustion chamber 3*a* of the cylinder head 3.

Figure 2:
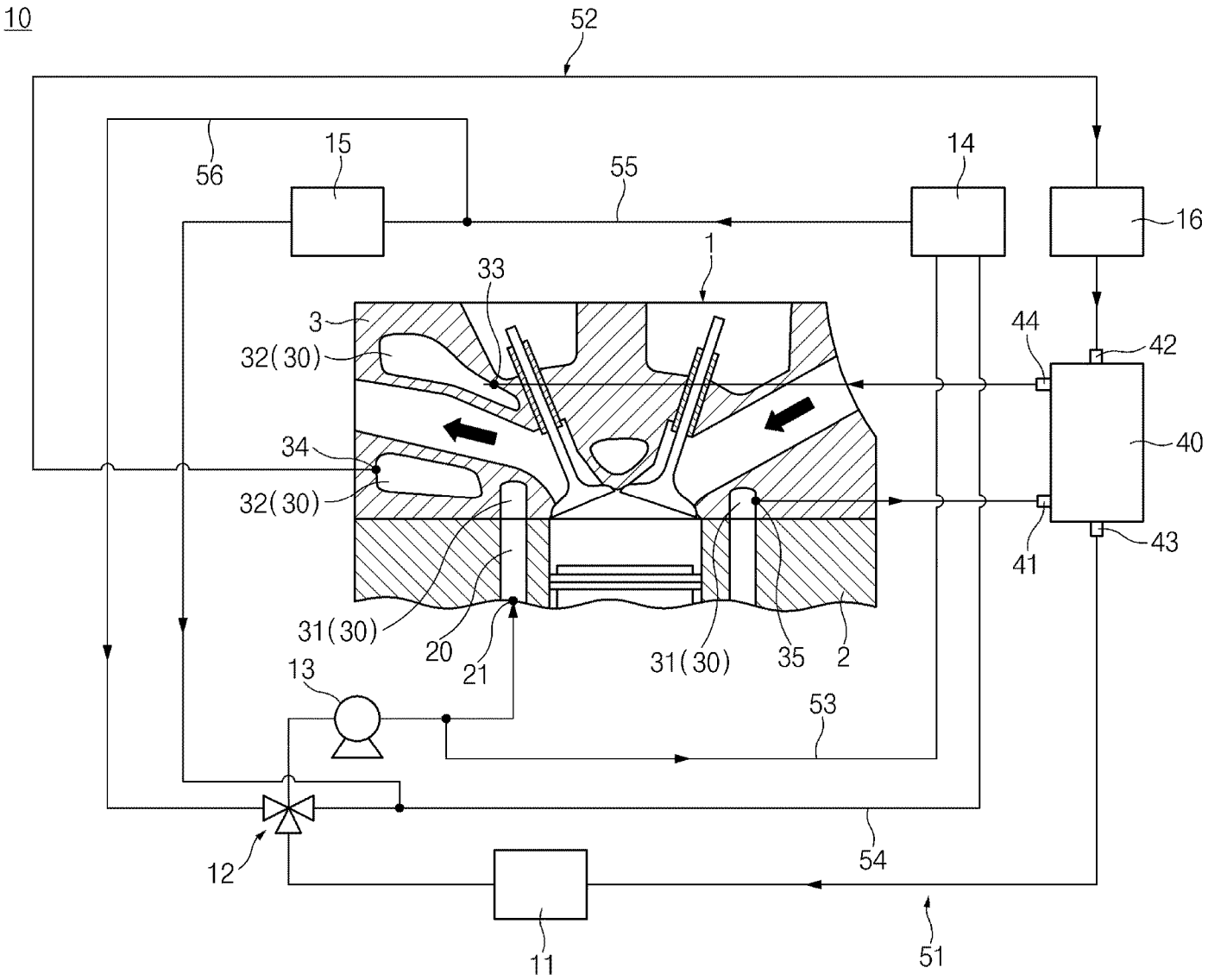
FIG. 2 illustrates the configuration of an engine cooling system according to an exemplary form of the present disclosure.

Referring to FIG. 2, an engine cooling system 10 according to an exemplary form of the present disclosure may include: a first coolant loop 51 communicating with the block-side water jacket 20 and the first coolant passage 31 of the head-side water jacket 30, a second coolant loop 52 communicating with the second coolant passage 32 of the head-side water jacket 30, and a coolant control valve 40 controlling the flow direction and flow rate of the coolant circulating through the first coolant loop 51 and the second coolant loop 52.

The coolant may circulate through the first coolant loop 51, and thus the coolant may pass through the block-side water jacket 20 and the first coolant passage 31 of the head-side water jacket 30. As the coolant passes through the block-side water jacket 20 and the first coolant passage 31, the cylinder 4 of the cylinder block 2 and the combustion chamber 3*a* of the cylinder head 3 may be cooled.

The first coolant loop 51 may include a coolant pump 13 to circulate the coolant, and a radiator 11 cooling the coolant. The radiator 11 may be an air-cooled or water-cooled heat exchanger.

An outlet of the coolant pump 13 may directly communicate with an inlet 21 of the block-side water jacket 20.

The coolant may circulate through the second coolant loop 52, and thus the coolant may pass through the second coolant passage 32 of the head-side water jacket 30. As the coolant passes through the second coolant passage 32 of the head-side water jacket 30, the exhaust port 3*c* of the cylinder head 3 may be cooled. The second coolant loop 52 may further include a heater 16 communicating with an outlet 34 of the second coolant passage 32 of the head-side water jacket 30.

The coolant control valve 40 may be a rotary valve including a valve housing having a plurality of inlets 41 and 42 and a plurality of outlets 43 and 44, and a valve body rotatably mounted in the valve housing. The coolant control valve 40 may adjust the opening rate of each of the plurality of inlets 41 and 42 and the plurality of outlets 43 and 44 individually.

According to an exemplary form, the coolant control valve 40 may include a first inlet 41 fluidly communicating with an outlet 35 of the first coolant passage 31 of the head-side water jacket 30, a second inlet 42 fluidly communicating with the outlet 34 of the second coolant passage 32, a first outlet 43 fluidly communicating with an inlet of the radiator 11, and a second outlet 44 fluidly communicating with an inlet 33 of the second coolant passage 32 of the head-side water jacket 30. The coolant control valve 40 may be configured to adjust the opening rate of the first inlet 41, the second inlet 42, the first outlet 43, and the second outlet 44.

The first inlet 41 of the coolant control valve 40 may directly communicate with the outlet 35 of the first coolant passage 31.

The second inlet 42 of the coolant control valve 40 may communicate with the outlet 34 of the second coolant passage 32 through the heater 16.

The first outlet 43 of the coolant control valve 40 may directly communicate with the inlet of the radiator 11.

The second outlet 44 of the coolant control valve 40 may directly communicate with the inlet 33 of the second coolant passage 32.

The opening rate of the first outlet 43 and the opening rate of the second outlet 44 may be adjusted by the operation of the coolant control valve 40 so that the flow rate and flow direction of the coolant flowing to the radiator 11 and the second coolant passage 32 of the head-side water jacket 30 may be controlled.

The opening rate of the first outlet 43 of the coolant control valve 40 may be varied according to operating conditions of the engine so that the flow rate of the coolant flowing to the radiator 11 may be appropriately controlled.

In addition, the opening rate of the second outlet 44 of the coolant control valve 40 may be varied according to engine RPM, temperature of the coolant, temperature of exhaust gas, and the like, so that the flow rate of the coolant flowing to the second coolant passage 32 of the head-side water jacket 30 may be independently controlled. For example, an exhaust flow rate may be reduced under the conditions of relatively low engine RPM and relatively high coolant temperature, thereby contributing to improving the overall cooling performance of the vehicle, and the flow rate of the coolant passing around the exhaust port 3*c* (that is, the flow rate of the coolant passing through the second coolant passage 32) may be increased under the conditions of relatively high engine RPM and relatively high exhaust gas temperature, thereby preventing damage to the cylinder head and lowering the temperature of the exhaust gas.

The engine cooling system 10 according to an exemplary form of the present disclosure may further include a first bypass conduit 53 branched from the first coolant loop 51.

One end of the first bypass conduit 53 may be branched at a downstream point of the coolant pump 13, and the other end of the first bypass conduit 53 may communicate with an inlet of an EGR cooler 14. The coolant may flow into the EGR cooler 14 through the first bypass conduit 53. That is, the coolant may flow into the EGR cooler 14 by making a detour around the water jackets 20 and 30 of the engine 1, thereby cooling the EGR cooler 14. The EGR cooler 14 may have a coolant passage (not shown) though which the coolant passes.

An outlet of the EGR cooler 14 may be connected to one end of a first return conduit 54, and the other end of the first return conduit 54 may be joined to the first coolant loop 51.

Another outlet of the EGR cooler 14 may be connected to a replenishment conduit 55. The replenishment conduit 55 may be jointed to one point of the first return conduit 54. A reservoir 15 may be connected to the replenishment conduit 55. Thus, a portion of the coolant from the EGR cooler 14 may be stored in the reservoir 15. A second bypass conduit 56 may be branched from the replenishing conduit 55. One end of the second bypass conduit 56 may be connected to a branch point of the replenishing conduit 55, and the other end of the second bypass conduit 56 may be jointed to one point of the first coolant loop 51. A three-way valve 12 may be disposed at a point at which the first coolant loop 51, the first return conduit 54, and the second bypass conduit 56 join.

Figure 3:
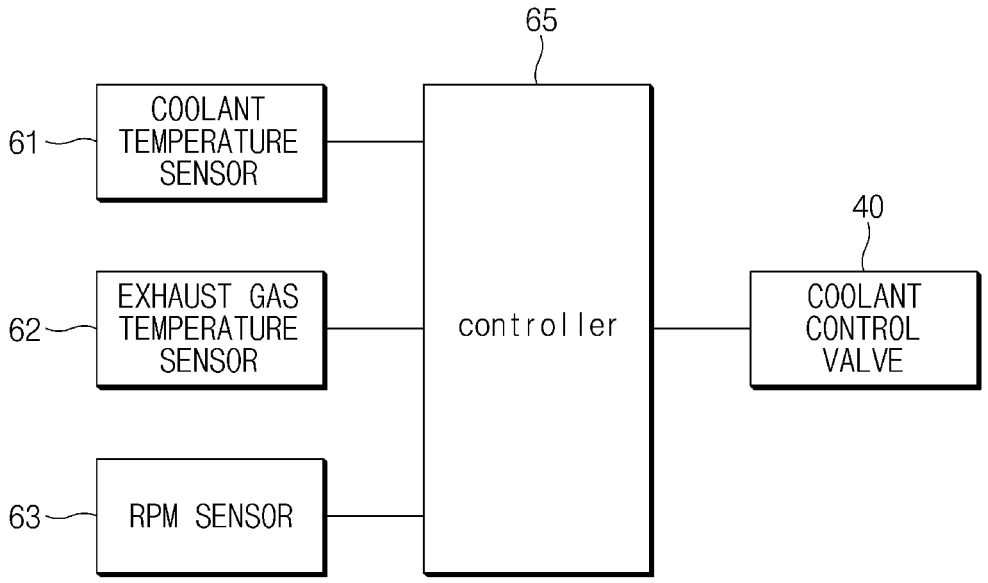
FIG. 3 illustrates a block diagram of an engine cooling system according to an exemplary form of the present disclosure.

FIG. 3 illustrates a block diagram of the engine cooling system 10 according to an exemplary form of the present disclosure.

Referring to FIG. 3, the engine cooling system 10 may include a coolant temperature sensor 61 measuring the temperature of the coolant, an exhaust gas temperature sensor 62 measuring the temperature of the exhaust gas, an RPM sensor 63 measuring the engine RPM, and a controller 65 controlling the coolant control valve 40.

The controller 65 may control the coolant control valve 40 to adjust the opening rate of the first outlet 43 of the coolant control valve 40 according to the engine RPM, the temperature of the coolant, the temperature of the exhaust gas, and the like. That is, the opening rate of the first outlet 43 of the coolant control valve 40 may be varied according to the operating conditions of the engine so that the flow rate of the coolant flowing to the radiator 11 may be appropriately adjusted, and thus the flow rate of the coolant flowing to the block-side water jacket 20 and the first coolant passage 31 of the head-side water jacket 30 may be adjusted.

In addition, the controller 65 may control the coolant control valve 40 to adjust the opening rate of the second outlet 44 of the coolant control valve 40 according to the engine RPM, the temperature of the coolant, the temperature of the exhaust gas, and the like. That is, the opening rate of the second outlet 44 of the coolant control valve 40 may be varied according to the operating conditions of the engine so that the flow rate of the coolant flowing to the second coolant passage 32 of the head-side water jacket 30 may be adjusted. For example, the controller 65 may reduce the opening rate of the second outlet 44 of the coolant control valve 40 under the conditions of relatively low engine RPM and relatively high coolant temperature, thereby reducing the flow rate of the coolant passing through the second coolant passage 32, thus improving the overall cooling performance of the engine cooling system. The controller 65 may increase the opening rate of the second outlet 44 of the coolant control valve 40 under the conditions of relatively high engine RPM and relatively high exhaust gas temperature, thereby increasing the flow rate of the coolant passing through the second coolant passage 32, thus preventing damage to the cylinder head and lowering the temperature of the exhaust gas.

As described above, the controller 65 may control the coolant control valve 40 in a manner that varies the flow rate of the coolant passing through the first coolant passage 31 and the flow rate of the coolant passing through the second coolant passage 32 independently according to the operating conditions of the engine. In particular, by adjusting the flow rate of the coolant passing through the second coolant passage 32 independently, cooling performance in a low speed condition and fuel economy in a high speed condition may be efficiently improved.

Figure 4:
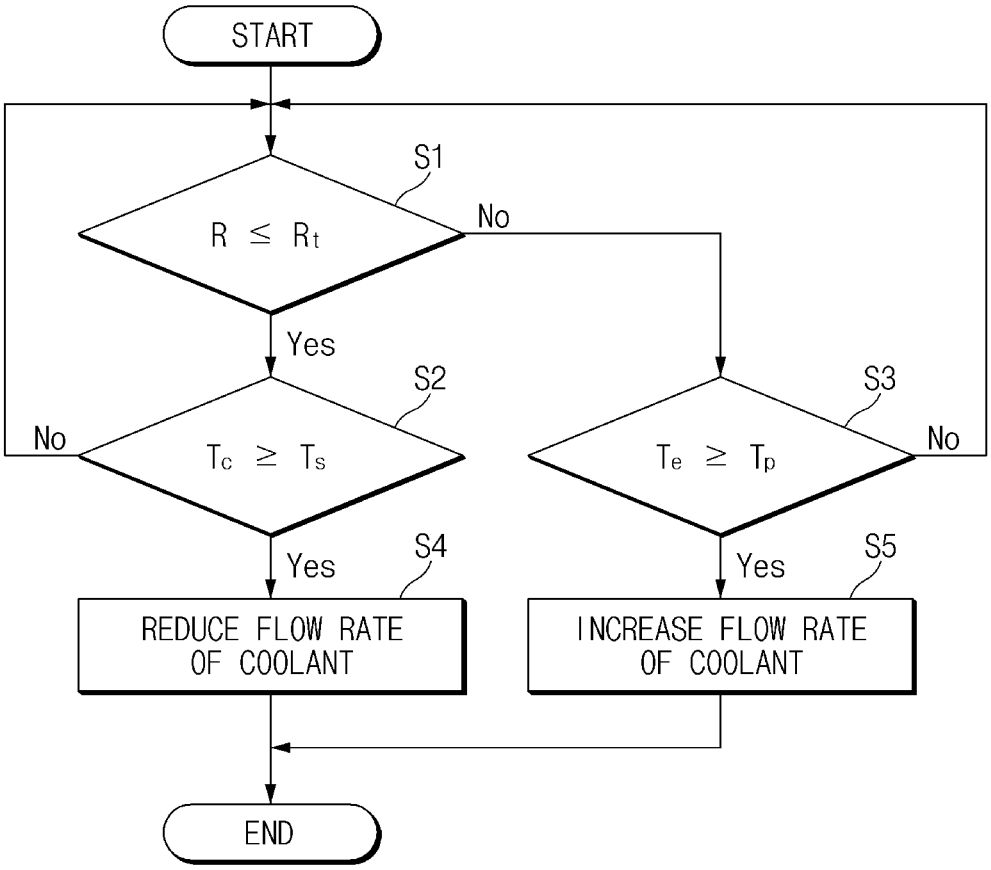
FIG. 4 illustrates a flowchart illustrating a method for controlling an engine cooling system according to an exemplary form of the present disclosure.

FIG. 4 illustrates a flowchart of a method for controlling the engine cooling system 10 according to an exemplary form of the present disclosure.

During the operation of the engine, the controller 65 may determine whether an RPM "R" of the engine measured by the RPM sensor 63 is lower than or equal to a predetermined reference RPM "Rt" in step S1.

When the measured engine RPM "R" is lower than or equal to the reference RPM "Rt" (low engine speed condition), the controller 65 may determine whether a temperature "Tc" of the coolant measured by the coolant temperature sensor 61 is higher than or equal to a predetermined reference coolant temperature "Ts" in step S2.

When the engine RPM "R" measured in step S1 is lower than or equal to the reference RPM "Rt" (low engine speed condition), and the coolant temperature "Tc" measured in step S2 is higher than or equal to the reference coolant temperature "Ts" (coolant overheating condition), the controller 65 may reduce the opening rate of the second outlet 44 of the coolant control valve 40 to a reference opening rate or less, thereby reducing the flow rate of the coolant passing through the second coolant passage 32 below a reference coolant flow rate in step S3. That is, when the low engine speed condition in which the measured engine RPM "R" is lower than or equal to the reference RPM "Rt" and the coolant overheating condition in which the measured coolant temperature "Tc" is higher than or equal to the reference coolant temperature "Ts" are satisfied, the controller 65 may reduce the opening rate of the second outlet 44 of the coolant control valve 40 to thereby reduce the flow rate of the coolant passing through the second coolant passage 32 (that is, the flow rate of the coolant passing around the exhaust port 3*c*).

When the low engine speed condition in which the engine RPM "R" measured in step S1 is lower than or equal to the reference RPM "Rt" is not satisfied, that is, when the measured engine RPM "R" exceeds the reference RPM "Rt" (high engine speed condition), the controller 65 may determine whether a temperature "Te" of the exhaust gas measured by the exhaust gas temperature sensor 62 is higher than or equal to a predetermined reference exhaust gas temperature "Tp" in step S4.

When the engine RPM "R" measured in step S1 exceeds the reference RPM "Rt" (high engine speed condition), and the exhaust gas temperature "Te" measured in step S4 is higher than or equal to the reference exhaust gas temperature "Tp" (high temperature exhaust gas condition), the controller 65 may increase the opening rate of the second outlet 44 of the coolant control valve 40 above the reference opening rate, thereby increasing the flow rate of the coolant passing through the second coolant passage 32 above the reference coolant flow rate in step S5. That is, when the high engine speed condition in which the measured engine RPM "R" exceeds the reference RPM "Rt" and the high temperature exhaust gas condition in which the measured exhaust gas temperature "Te" is higher than or equal to the reference exhaust gas temperature "Tp" are satisfied, the controller 65 may increase the opening rate of the second outlet 44 of the coolant control valve 40 to thereby increase the flow rate of the coolant passing through the second coolant passage 32 (that is, the flow rate of the coolant passing around the exhaust port 3*c*).

As set forth above, the water jacket and the engine cooling system, according to exemplary forms of the present disclosure, may vary the flow rate of the coolant passing around the exhaust port according to the operating conditions of the vehicle, thereby improving engine cooling performance, preventing heat damage to the cylinder head and the exhaust system, and improving fuel efficiency.

In particular, according to exemplary forms of the present disclosure, the flow rate of the coolant passing through the exhaust port may be reduced under the conditions of relatively low engine RPM and relatively high coolant temperature, thereby improving the overall cooling performance of the vehicle, and the flow rate of the coolant passing through the exhaust port may be increased under the conditions of relatively high engine RPM and relatively high exhaust gas temperature, thereby preventing damage to the cylinder head and lowering the temperature of the exhaust gas.

Hereinabove, although the present disclosure has been described with reference to exemplary forms and the accompanying drawings, the present disclosure is not limited thereto, but may be variously modified and altered by those skilled in the art to which the present disclosure pertains without departing from the spirit and scope of the present disclosure.

What is claimed is:

1. An engine cooling system, comprising:

an engine including: a cylinder block having a block-side water jacket, and a cylinder head having a first coolant passage surrounding a combustion chamber of the cylinder head, and a second coolant passage surrounding an exhaust port of the cylinder head;

a first coolant loop communicating with the block-side water jacket and the first coolant passage of the head-side water jacket;

a second coolant loop communicating with the second coolant passage of the head-side water jacket; and a coolant control valve controlling a flow direction and a flow rate of a coolant circulating through the first coolant loop and the second coolant loop, wherein the coolant control valve is configured to:

receive the coolant having circulated the second coolant loop and directly send the received coolant to the second coolant passage, and directly receive the coolant from the first coolant passage and send to the first coolant loop.

2. The engine cooling system according to claim 1, wherein the first coolant loop includes a coolant pump configured to circulate the coolant, and a radiator configured to cool the coolant.

3. The engine cooling system according to claim 2, wherein the second coolant loop includes a heater communicating with an outlet of the second coolant passage.

4. The engine cooling system according to claim 3, wherein the coolant control valve includes:

a first inlet fluidly communicating with an outlet of the first coolant passage such that the coolant control valve directly receives the coolant from the outlet of the first coolant passage, a second inlet fluidly communicating with the outlet of the second coolant passage such that the coolant valve receives the coolant having circulated the second coolant loop, a first outlet fluidly communicating with an inlet of the radiator, and a second outlet fluidly communicating with an inlet of the second coolant passage such that the coolant valve directly sends the coolant to the inlet of the second coolant passage.

5. The engine cooling system according to claim 1, further comprising:

a coolant temperature sensor configured to measure a temperature of the coolant;

an exhaust gas temperature sensor configured to measure a temperature of an exhaust gas;

an revolutions per minute (RPM) sensor configured to measure an RPM of the engine; and a controller configured to control the coolant control valve.

6. The engine cooling system according to claim 5, wherein the controller is configured to control the coolant control valve so as to vary the flow rate of the coolant passing through the first coolant passage and the flow rate of the coolant passing through the second coolant passage independently based on operating conditions of the engine.

7. The engine cooling system according to claim 5, wherein the controller is configured to reduce an opening rate of a second outlet of the coolant control valve to a predetermined reference opening rate or less when the RPM of the engine measured by the RPM sensor is lower than or equal to a reference RPM.

8. The engine cooling system according to claim 5, wherein the controller is configured to reduce an opening rate of a second outlet of the coolant control valve to a predetermined reference opening rate or less when the RPM of the engine measured by the RPM sensor is lower than or equal to a reference RPM, and the temperature of the coolant measured by the coolant temperature sensor is higher than or equal to a reference coolant temperature.

9. The engine cooling system according to claim 5, wherein the controller is configured to increase an opening rate of a second outlet of the coolant control valve above a predetermined reference opening rate when the RPM of the engine measured by the RPM sensor exceeds a reference RPM.

10. The engine cooling system according to claim 5, wherein the controller is configured to increase an opening rate of a second outlet of the coolant control valve above a predetermined reference opening rate when the RPM of the engine measured by the RPM sensor exceeds a reference RPM, and the temperature of the exhaust gas measured by the exhaust gas temperature sensor is higher than or equal to a reference exhaust gas temperature.

* * * * *